US008121518B2

(12) United States Patent
Sato

(10) Patent No.: US 8,121,518 B2
(45) **Date of Patent: *Feb. 21, 2012**

(54) COMBINATION IN WHICH TONER CARTRIDGE IS REMOVABLY INSTALLED IN DEVELOPING CARTRIDGE, WHICH IS REMOVABLY INSTALLED IN PHOTOCONDUCTOR CARTRIDGE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/823,647

(22) Filed: Jun. 25, 2010

(65) Prior Publication Data

US 2010/0260516 A1 Oct. 14, 2010

Related U.S. Application Data

(63) Continuation of application No. 11/382,579, filed on May 10, 2006.

(30) Foreign Application Priority Data

May 11, 2005 (JP) ..... 2005-138779
May 23, 2005 (JP) ..... 2005-149750

(51) Int. Cl.
*G03G 21/16* (2006.01)

(52) U.S. Cl. ..... 399/111; 399/113

(58) Field of Classification Search ..... 399/111, 399/113, 114, 262
See application file for complete search history.

(56) References Cited

U.S. PATENT DOCUMENTS

| | | | |
|---|---|---|---|
| 4,523,834 | A | 6/1985 | Pelda et al. |
| 5,153,640 | A | 10/1992 | Okabe |
| 5,668,635 | A | 9/1997 | Tomida et al. |
| 5,787,323 | A | 7/1998 | Nomura et al. |
| 5,835,822 | A | 11/1998 | Nagasaki et al. |
| 5,842,091 | A | 11/1998 | Nakano |
| 5,884,136 | A | 3/1999 | Takei et al. |

(Continued)

FOREIGN PATENT DOCUMENTS

CN 1410844 A 4/2003

(Continued)

OTHER PUBLICATIONS

JP Office Action dtd Aug. 31, 2010, JP Appln. 2005-149750, English translation.

(Continued)

*Primary Examiner* — David Gray
*Assistant Examiner* — Laura Roth
(74) *Attorney, Agent, or Firm* — Banner & Witcoff, Ltd.

(57) ABSTRACT

An image forming apparatus is provided which can be switched between states in which a developing roller is attached to an image carrier body by applying a pressing force to a developing cartridge and a state in which the developing roller can be released from attachment from the image carrier body. When an operation part of a toner cartridge is arranged at an installation position a pressing force can be applied to a developing cartridge by protruding parts fitting with spring parts, and a developing roller can be attached to a photoconductor drum by the applied pressure. When the operation part is arranged at a removal position, the fitting can be undone, causing the applied pressure to be released.

14 Claims, 14 Drawing Sheets

U.S. PATENT DOCUMENTS

| | | | | |
|---|---|---|---|---|
| 5,895,143 | A | 4/1999 | Kawahara et al. | |
| 6,041,203 | A | 3/2000 | Suzuki et al. | |
| 6,088,556 | A | 7/2000 | Nagasaki et al. | |
| 6,101,350 | A | 8/2000 | Suzuki et al. | |
| 6,330,410 | B1 | 12/2001 | Okabe et al. | |
| 6,853,821 | B2 | 2/2005 | Ishiguro et al. | |
| 7,747,192 | B2 * | 6/2010 | Sato | 399/111 |
| 2003/0068172 | A1 | 4/2003 | Komatsu et al. | |
| 2003/0118370 | A1 | 6/2003 | Okabe et al. | |
| 2003/0219284 | A1 | 11/2003 | Ishiguro et al. | |
| 2004/0179859 | A1 | 9/2004 | Ishii | |
| 2005/0053394 | A1 | 3/2005 | Ishii et al. | |
| 2006/0177241 | A1 | 8/2006 | Sato et al. | |

FOREIGN PATENT DOCUMENTS

| | | | |
|---|---|---|---|
| CN | 1467582 | A | 1/2004 |
| EP | 0793149 | A1 | 9/1997 |
| EP | 1316852 | A2 | 6/2003 |
| EP | 1434108 | A2 | 6/2004 |
| JP | 4-142568 | A | 5/1992 |
| JP | 8-305148 | A | 11/1996 |
| JP | 9-081016 | A | 3/1997 |
| JP | 9-288394 | A | 11/1997 |
| JP | 9-319207 | A | 12/1997 |
| JP | 2000-250378 | A | 9/2000 |
| JP | 2002-171372 | A | 6/2002 |
| JP | 2002-278427 | A | 9/2002 |
| JP | 2003-345130 | A | 12/2003 |
| JP | 2007-011065 | A | 1/2007 |

OTHER PUBLICATIONS

EP Search Report dtd Aug. 18, 2006, EP Appln. 06009657.
CN Office Action dtd Apr. 4, 2008, CN Appln. 2006100819494.
JP Office Action dtd Feb. 8, 2011, JP Appln. 2010-243134, English translation.

* cited by examiner

COMBINATION IN WHICH TONER CARTRIDGE IS REMOVABLY INSTALLED IN DEVELOPING CARTRIDGE, WHICH IS REMOVABLY INSTALLED IN PHOTOCONDUCTOR CARTRIDGE

CROSS REFERENCE TO RELATED APPLICATIONS

This application is a continuation of U.S. application Ser. No. 11/382,579, filed May 10, 2006, which claims priority from Japanese Patent Application Nos. 2005-138779, filed on May 11, 2005, and 2005-149750, filed May 23, 2005, the entire subject matter of which is incorporated herein by reference.

FIELD

Aspects of the present invention relate to an image forming apparatus of a so-called electronic photographic system that forms an image by developing an electrostatic latent image formed on an image carrier body using toner and causing the image to adhere to a recording medium, and to a process cartridge, a main body cartridge, an image carrier body cartridge, a developing cartridge, and a toner cartridge that can be used in the image forming apparatus.

BACKGROUND

In the past, image forming apparatuses have included an image carrier body, having a surface on which an electrostatic latent image is formed, a developing roller, which causes toner to adhere to the surface of the image carrier body to develop the electrostatic latent image, a transfer roller, which transfers to a recording medium the toner that has adhered to the surface of the image carrier body by the developing roller, and a toner cartridge, in which the toner is accommodated and that is configured so that it can be installed and removed.

In this type of image forming apparatus, when an electrostatic latent image is formed on the surface of the image carrier body, the developing roller causes toner that is held in a toner cartridge to adhere to the surface of the image carrier body to develop the electrostatic latent image. Then, it is possible to form an image that corresponds to the electrostatic latent image on the recording medium by the transfer roller transferring the toner that has adhered to the surface of the image carrier body to the recording medium.

In addition, in this type of image forming apparatus, pressure attachment of a developing means such as a developing roller to an image carrier body that uses and OPC (organic photoconductor), etc. is performed using a spring, etc., and the development is performed. However, when the OPC and the developing roller continue to be mutually pressure attached for a long period of time without rotation, there is a possibility of chemical damage to the OPC occurring or of the developing roller becoming permanently deformed. In this regard, it has been proposed that the two be separated by configuring the developing roller and the image carrier body so that they can approach and separate and inserting a wedge member between the developing means and the image carrier body at the time of shipping of the image forming apparatus.

SUMMARY

Certain aspects of the present invention are directed to a process cartridge. According to one illustrative aspect a process cartridge includes an image carrier body having a surface on which an electrostatic latent image is formed, a developing roller configured to cause toner to adhere to the surface of the image carrier body to develop the electrostatic latent image, and a single or plural separable housing configured to support the image carrier body and the developing roller, the housing configured to allow the developing roller to be attached to said image carrier body and to be detached from said image carrier body in response to a pressing force. Also, the process cartridge includes a toner cartridge, for holding the toner, the toner cartridge being configured to be installed in and removed from the housing, and a pressure attachment device that is configured to attach the image carrier body and the developing roller by applying a pressing force when the toner cartridge is installed in the housing and is configured release the pressure attachment of the image carrier body and the developing roller when the toner cartridge is removed from the housing.

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
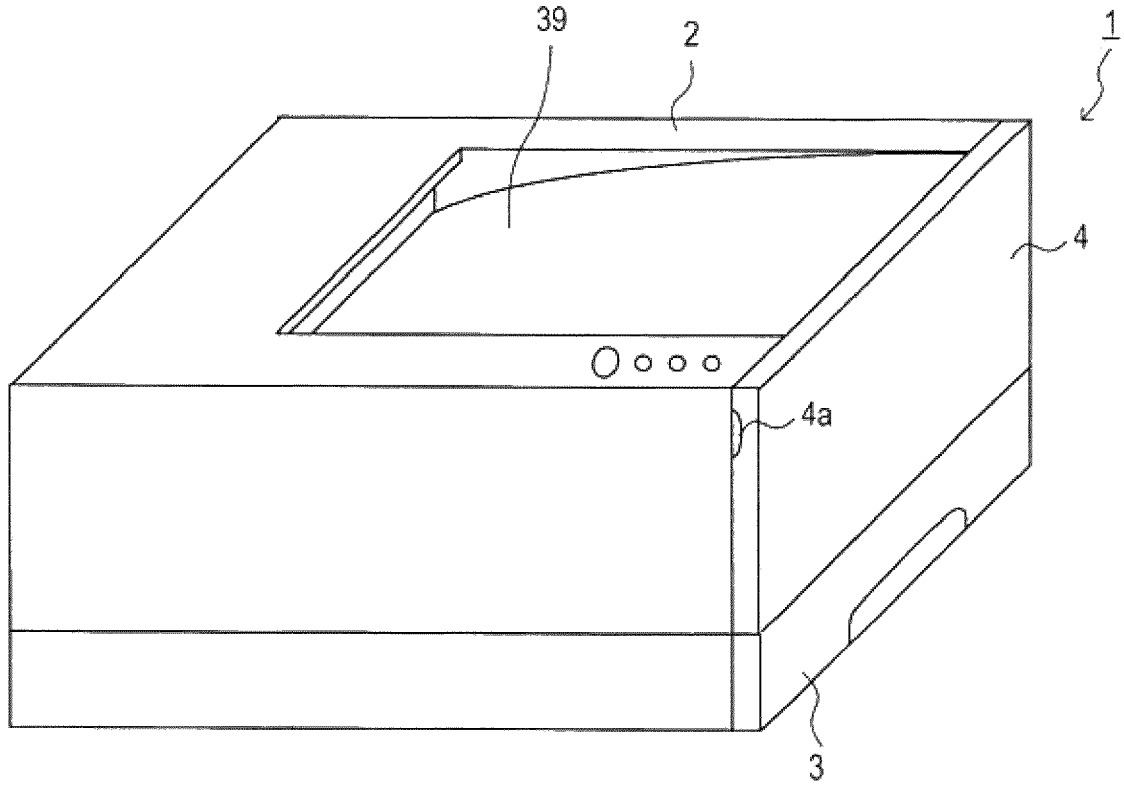
FIG. 1 is an oblique view that shows the external appearance of a laser printer to according to illustrative aspects of the present invention.

Next, illustrative aspects of the present invention will be explained using the drawings. FIG. 1 is an oblique view that shows the external appearance of a laser printer 1 functioning as the image forming apparatus according to an illustrative application of the present invention. As shown in FIG. 1, a paper feed cassette 3 is installed at the bottom part of the cover 2 that covers the main body of a laser printer 1 from the outer circumference A lid portion 4 of the cover 2 is provided at the front surface (specifically, at the surface arranged in the front at the time of installation of the laser printer 1) of the cover 2.

Figure 2:
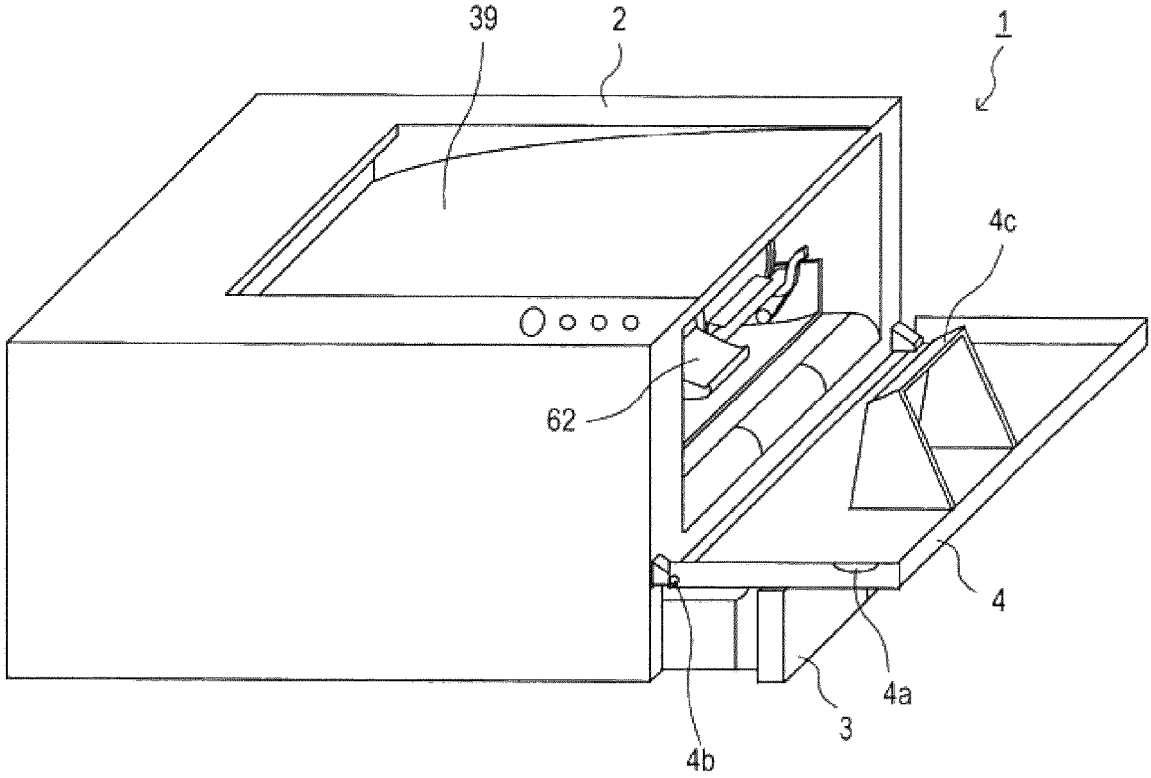
FIG. 2 is an oblique view that shows the operation of releasing the lid part of the laser printer of FIG. 1.

The lid part 4 includes a finger grip part 4*a* at the top of both of the left and right ends. By pulling the finger grip part 4*a*, it is possible to open the lid part 4 in a forward direction centering on the hinge 4*b* of the lower end as shown in FIG. 2. In addition, as shown in FIG. 2, a paper feed cassette 3 is provided so that it can be pulled out toward the front. As such, the paper feed cassette 3 can be installed in and removed from a laser printer 1.

Figure 3:
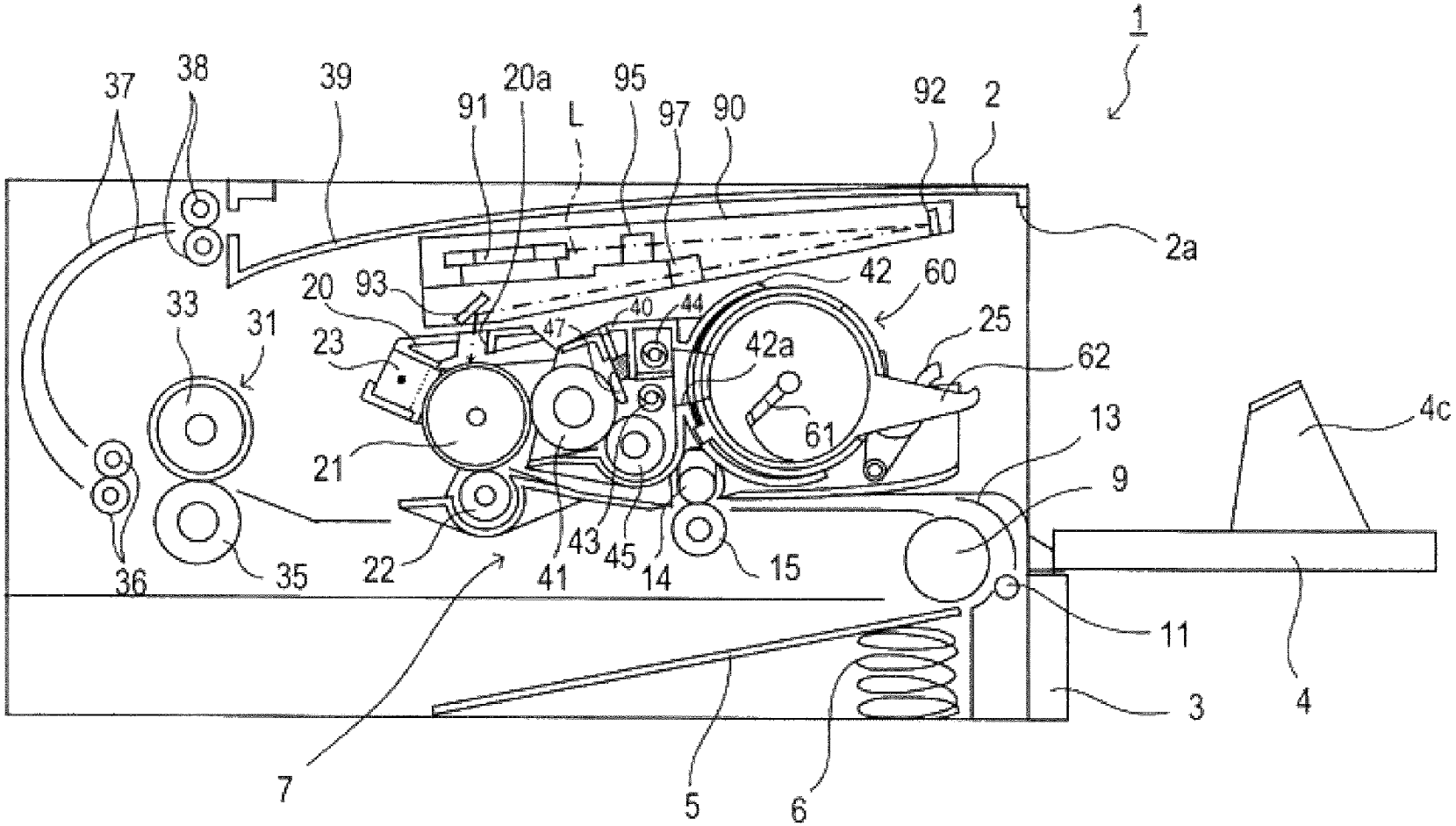
FIG. 3 is a vertical cross sectional view that shows the internal configuration of the laser printer of FIG. 1.

Next, FIG. 3 is a vertical cross sectional drawing that shows the internal configuration of the laser printer 1. As shown in FIG. 3, a support plate 5 that has energy imparted to it in an upward direction by a spring 6 is provided in the interior of the paper feed cassette 3, and a paper feed roller 9, which feeds paper (not shown in the drawing) held in a stacked state on the support plate 5 toward the image forming part 7 separately one sheet at a time, is arranged further up on the front surface side of the support plate 5. In addition, a conveyance roller 11, which operates in conjunction with the paper feed roller 9 to convey the paper, and a guide 13, which returns the paper conveyed by the conveyance roller 11 approximately 180° along the outer circumference of the paper feed roller 9, and a pair of resist rollers 14 and 15, which catch the front edge of the paper by appropriately stopping and adjusting the angular advance of the paper, are sequentially arranged in the conveyance path of the paper from the paper feed roller 9 to the image forming part 7.

The image forming part 7 includes a photoconductor drum 21 as the image carrier body provided inside the photoconductor cartridge 20 and a transfer roller 22 opposing the photoconductor drum 21. Note that the photoconductor drum 21 is a well-known type that forms an organic photoconductor (OPC) layer on the surface of a grounded metal core.

The paper, which passes between this photoconductor drum 21 and transfer roller 22 and on which an image resulting from toner is formed in the manner discussed below, is fed to a fixing part 31. At the fixing part 31, the toner image that is formed on the paper is held between a heating roller 33 and a transfer roller 35 and fixed by the heat, and the paper on which the image has been fixed is further conveyed by a pair of conveyance rollers 36 and 36.

The paper, which has been conveyed by the conveyance rollers 36 and 36, is guided above the cover 2 by a guide 37, and is ejected to a paper eject tray 39 provided on the upper surface of the cover 2 by a pair of paper eject rollers 38 and 38. In addition, a scanner unit 90, which exposes the photoconductor drum 21 using laser light L, is arranged between the paper eject tray 39 and the photoconductor cartridge 20.

Next, the configuration of the image forming part 7 and the scanner unit 90 will be explained in further detail. The photoconductor cartridge 20 as the image carrier body cartridge includes a photoconductor drum 21 so as to be rotatable and further includes a scorotron charging unit 23 that uniformly charges the surfaces of the transfer roller 22 and the photoconductor drum 21. An electrostatic latent image is formed by laser light L incident from the scanner unit 90 via an exposure aperture part 20*a* on the surface of the photoconductor drum 21 charged by the scorotron charging unit 23. Next, the electrostatic latent image is developed by a developing roller 41 provided on a developing cartridge 40 by supplying toner to the surface of the photoconductor drum 21. This is because the toner that has adhered to the photoconductor drum 21 is transferred to the paper that has passed the aforementioned transfer roller 22, and an image is formed on that paper by the above operation.

The developing roller 41 is rotatably supported by the developing cartridge 40 as shown in FIG. 3 and comes into contact with the photoconductor drum 21 and is rotated and driven by a mechanism discussed below. The developing cartridge 40 includes an installation part 42 that supports a toner cartridge 60 so that it can be installed and removed and an aperture part 42*a*, by which toner is supplied from the toner cartridge 60, is bored into the installation part 42. In addition, a lower auger 43, which conveys the toner supplied from the aperture part 42*a* provided at the center portion in the shaft direction to both sides in the shaft direction, an upper auger 44, which conveys the toner that has been conveyed by the lower auger 43 and has accumulated at both sides in the shaft direction to the center portion of the shaft direction and returns it to the toner cartridge 60 via the aperture part 42*a*, a supply roller 45, which feeds the toner conveyed by the lower auger 43 toward the developing roller 41, and a developing blade 47, which through friction charges the toner that has adhered to the surface of the developing roller 41 by the supply roller 45 and forms a thin layer of toner, are provided in the developing cartridge 40. Also, an agitator 61 for agitating the accommodated toner and supplying it to the developing cartridge 40 side is provided in the interior of the toner cartridge 60.

Next, the configuration of the scanner unit 90 will be explained. Scanner unit 90 includes a polygon mirror 91, which deflects and scans the laser light L generated by a laser emission part that is not shown in the drawing, and mirrors 92, 93 that return the laser light L deflected by that polygon mirror 91 toward the photoconductor drum 21. Also, an fθ lens 95 and a cylindrical lens 97 are respectively fixed in the optical path of the laser light L that has reached mirror 92 from the polygon mirror 91 and in the optical path of the laser light L that has reached mirror 93 from mirror 92.

Through the above configuration, it is possible to form an electrostatic latent image on the surface of the photoconductor drum 21 by emitting laser light L at the appropriate timing while rotating the polygon mirror 91 and the photoconductor drum 21. Then, in the aforementioned way, image formation by an electronic photographic system is possible by developing the electrostatic latent image using toner via a developing roller 41 and transferring it to paper.

Figure 4A:
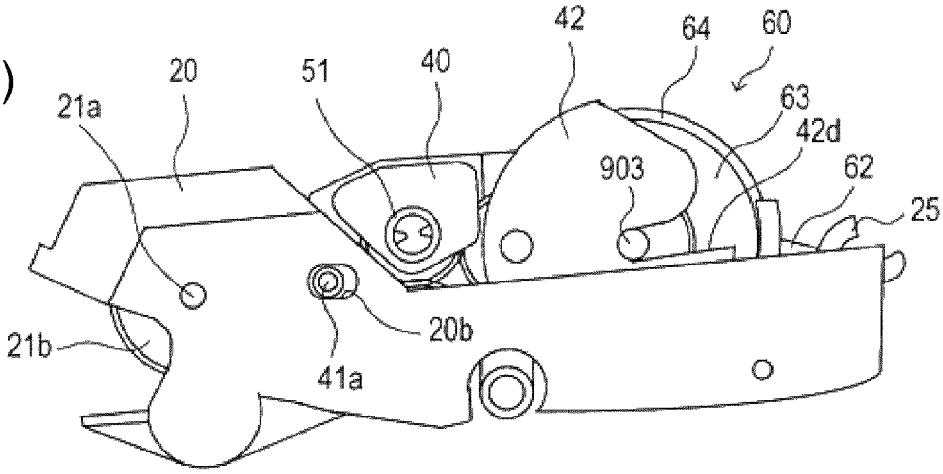
FIG. 4 is a side surface view that shows the external appearance of the photoconductor cartridge, the developing cartridge, and the toner cartridge of the laser printer of FIG. 1.
Figure 4B:
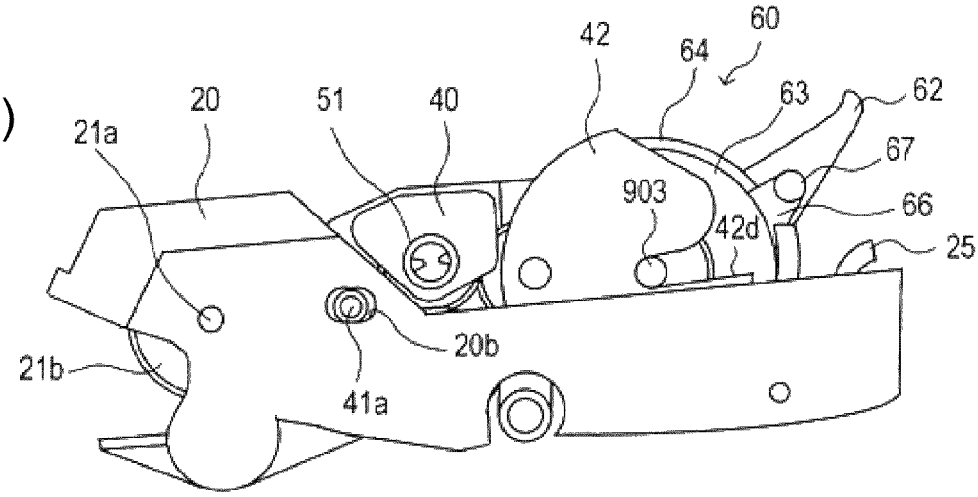
Figure 4C:
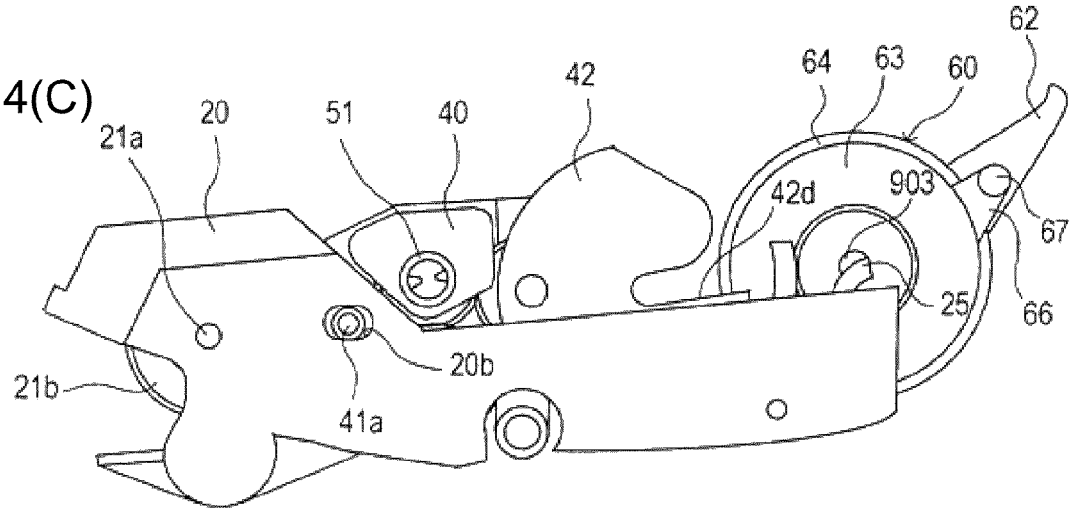

FIG. 4 is a side view that shows the external appearance of the photoconductor cartridge 20, the developing cartridge 40, and the toner cartridge 60. At the time of image formation, the operation part 62 of the toner cartridge 60 is arranged at the installation position shown in FIG. 3 and FIG. 4(A), and in this state, the three parts, which are the photoconductor cartridge 20, the developing cartridge 40, and the toner cartridge 60, are unified. For this reason, when the lid part 4 is opened and, also, the operation part 62 is pulled forward when the operation part 62 has been arranged at the installation position, the aforementioned three parts can be taken out as a unit from the installation and removal port 2*a* (see FIG. 3) to outside the main body of the laser printer 1. Note that the installation and removal port 2*a* is an aperture part of the cover 2 that is closed by the lid 4.

When the operation part 62 of the toner cartridge 60 is rotated upward and arranged at the removal position shown in FIG. 4(B), the toner cartridge 60 is separated from a photoconductor cartridge 20 and a developing cartridge 40, and when that operation part 62 is further pulled forward, it is possible to separate only the toner cartridge 60 as shown in FIG. 4(B) and take it out from the removal port 2*a* to outside the main body of the laser printer 1. Through this, it is possible to replace the toner cartridge 60.

In addition, a rotary shaft 41*a* (see FIG. 5) of the developing roller 41 protrudes from the side surface of the developing cartridge 40, and fits into a slot 20*b* that is bored into the photoconductor cartridge 20. Due to this fitting, the developing cartridge 40 is movably linked to the photoconductor cartridge 20 along the line that joins the photoconductor drum 21 and the installation part 42. In addition, when the operation part 62 is arranged at the installation position, the developing roller 41 is attached to the photoconductor drum 21 by applying a pressing force as explained below, and when the operation part 62 is arranged at the removal position, the pressing force is released.

Next, the configuration for installing and removing the toner cartridge 60 in this way will be explained. First, the configuration for switching between linkage and separation of the developing cartridge 40 and the toner cartridge 60 will be explained.

Figure 5A:
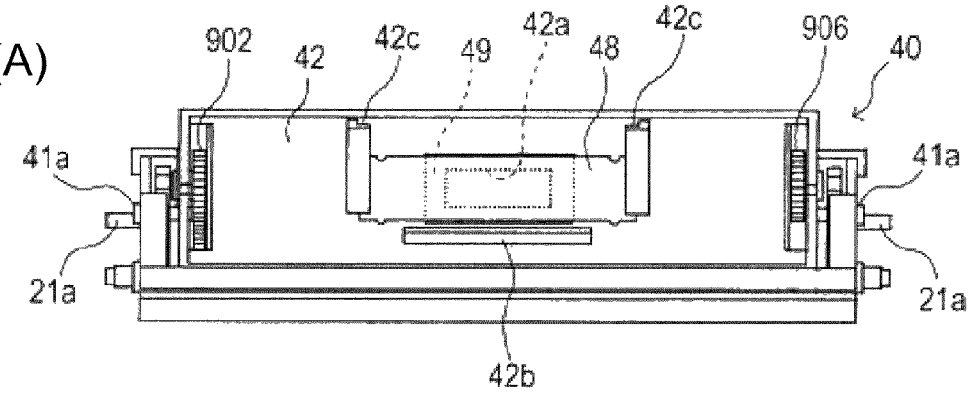
FIG. 5 is an explanatory drawing that shows the configuration of the mechanism that switches between linking and separating of the developing cartridge and the toner cartridge of the laser printer of FIG. 1.
Figure 5B:
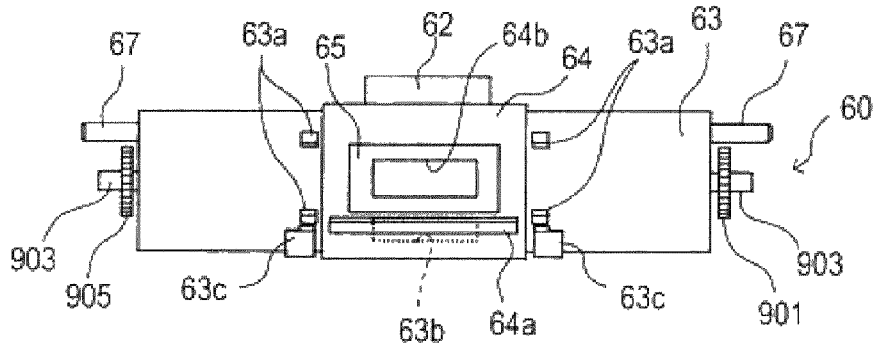

FIGS. 5(A) and (B) show how the operation part 62 of the toner cartridge 60 has been arranged at the removal position, where FIG. 5(A) is a drawing of the installation part 42 of the developing cartridge 40 as seen from the toner cartridge 60 side, and FIG. 5(B) is a drawing of the toner cartridge 60 as seen from the installation part 42 side.

As shown in FIG. 5(B), the toner cartridge 60 includes a long cylindrical inner cylinder 63 whose interior accommodates the toner and an outer cylinder 64 that fits onto the outside of the center portion of that inner cylinder 63. The outer cylinder 64 is installed on the installation part 42 so that it cannot be rotated by engaging a protruding stripe 64*a* that protrudes at the installation part 42 side with a long groove 42*b* formed on the inner wall surface of the installation part 42. The inner cylinder 63 is such that the aforementioned operation part 62 is molded as a unit, and it is configured at the inner side of the outer cylinder 64 so that it is able to rotate according to the operation of the operation part 62.

In addition, as shown in FIG. 5(A), a shutter 48 including a metal plate is arranged at the inside of the installation part 42. The shutter 48 is arranged so that it is movable in the direction of the inner circumference of the installation part 42 between the position at which the aperture part 42*a* of the installation part 42 is closed and a position (refer to FIG. 5(C)) arranged to be shifted above the aperture part 42*a* as shown in FIG. 5(A) by supporting both ends by the rails 42*c* formed at the inner wall surface of the installation part 42.

Four protrusions 63*a* which interpose the vicinity of both ends of the shutter 48 from both sides of the circumferential direction are formed on the surface of the inner cylinder 63. For this reason, the shutter 48 moves according to the rotation of the inner cylinder 63, and when the operation part 62 is arranged at the removal position, as shown in FIG. 5(A), the shutter 48 is arranged at a position that closes the aperture part 42*a*. Note that the long groove 42*b* discussed above is formed further below that so that it does not stack with the shutter 48 arranged at this position. In addition, the aperture part 42*a* is formed in a lengthwise shape that is long in the horizontal direction, and a rectangular frame-shaped sponge 49 that surrounds the aperture part 42*a* is affixed at the inner wall surface of the installation part 42 in that vicinity.

An aperture part 64*b* of the same shape as aperture part 42*a* is formed at a portion of the outer cylinder 64 that opposes aperture part 42*a* when the protruding stripe 64*a* is engaged with the long groove 42*b*, and a sponge 65 of the same shape as sponge 49 is affixed in the vicinity thereof. In addition, an aperture part 63*b* of the same shape as aperture part 64*b* is formed on the inner cylinder 63 as well, but when the operation part 62 is arranged at the removal position, aperture part 64*b* and aperture part 63*b* do not stack at all, as shown in FIG. 5(B). For this reason, the toner of the interior does not spill even when the toner cartridge 60 is removed.

Figure 5C:
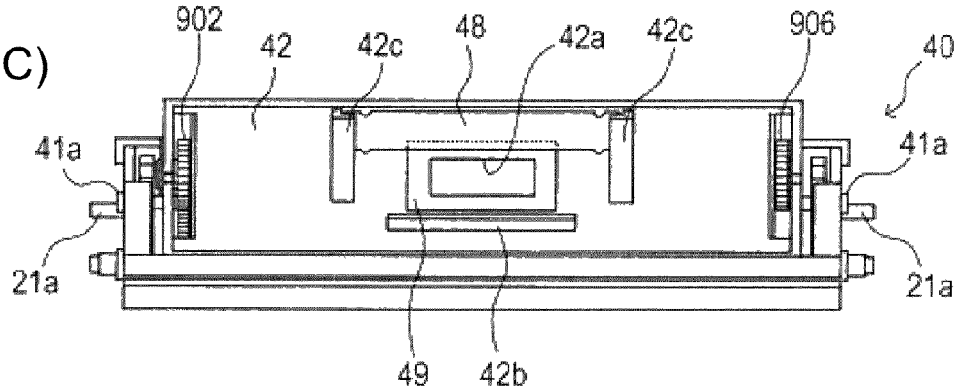
Figure 5D:
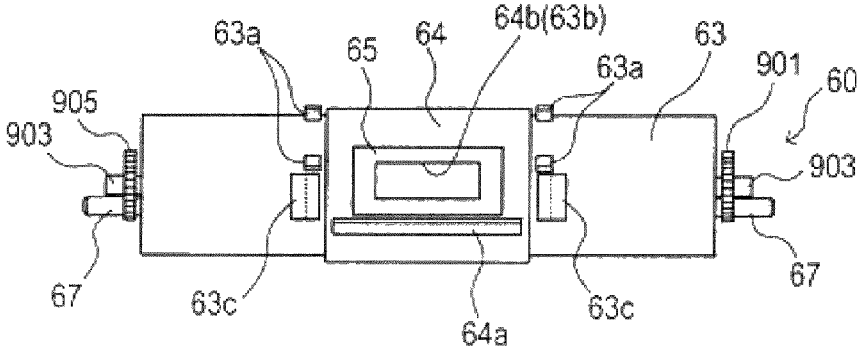

In addition, after the protruding stripe 64*a* has engaged with the long groove 42*b*, when the operation part 62 of the toner cartridge 60 is arranged at the installation position, aperture part 64*b* and aperture part 63*b* stack as shown in FIG. 5(D). In addition, at this time, as shown in FIG. 5(C), the shutter 48 is moved to above aperture part 42*a* by the protrusions 63*a*, so both aperture part 64*b* and aperture part 42*a* communicate, and it becomes possible to supply the toner from the toner cartridge 60 to developing cartridge 40.

Also, at this time, sponge 49 and sponge 65 closely adhere, and, moreover, the engagement parts 63*c* formed on the outer circumference surface of the inner cylinder 63 engage with the rails 42*c*, so the vicinities of aperture parts 64*b* and 42*a* are tightly sealed, and toner is prevent from spilling out to the exterior. In addition, through this engagement of the engagement parts 63*c* and rails 42*c*, the developing cartridge 40 and the toner cartridge 60 are linked. Conversely, by arranging the operation part 62 at the removal position and releasing the engagement of the engagement parts 63*c* and the rails 42*c*, the direct linkage between the developing cartridge 40 and the toner cartridge 60 is released.

Also, a gear 901 that rotates in unison with the agitator 61 is arranged at the outer side of one end of the inner cylinder 63, and a gear 902 for transmitting driving force to that gear 901 is exposed at a position that opposes the gear 901 of the installation part 42. For this reason, by installing the toner cartridge 60 in the installation part 42 and engaging the engagement parts 63*c* with the rails 42*c* in the manner discussed above, it is possible to drive the agitator 61 via gears 902 and 901.

Furthermore, the rotary shaft 903 of gear 901 protrudes to the left and right as shown in FIGS. 5(B) and (D), and a gear 905 is arranged at the other end of the rotary shaft 903. A gear 906 for transmitting driving force to the lower auger 43 and the upper auger 44 is exposed at a position that opposes gear 905 of the installation part 42. Note that the driving force transmission mechanisms of these will be discussed below.

As shown in FIG. 4, guide grooves 42*d* that guide this rotary shaft 903 are formed at the left and right end surfaces of the installation part 42. The rotary shaft 903 is guided by the guide grooves 42*d* at the time of installation of the toner cartridge 60, so it is easy to engage the protruding stripe 64*a* with the long groove 42*b*.

Figure 6A:
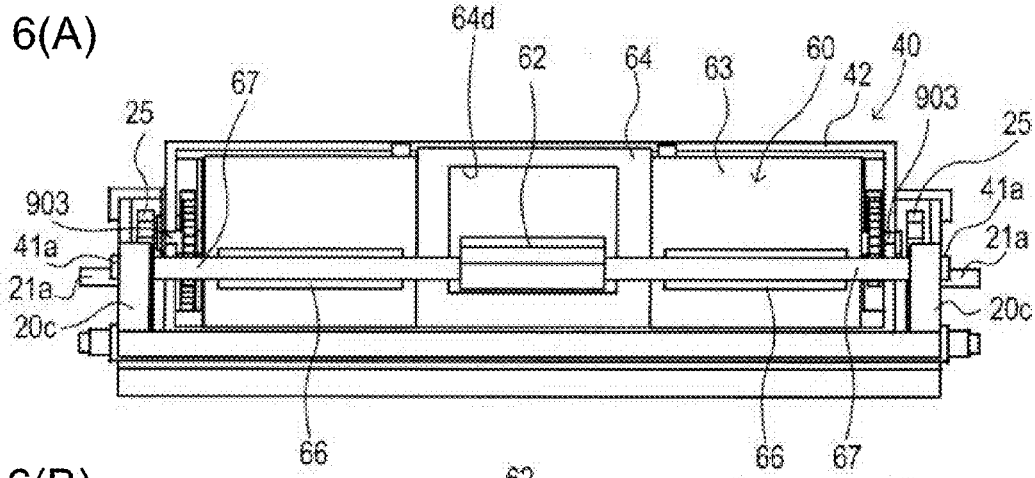
FIG. 6 is an explanatory drawing that shows an illustrative condition in which the toner cartridge has been installed in the developing cartridge from the front side surface.
Figure 6B:
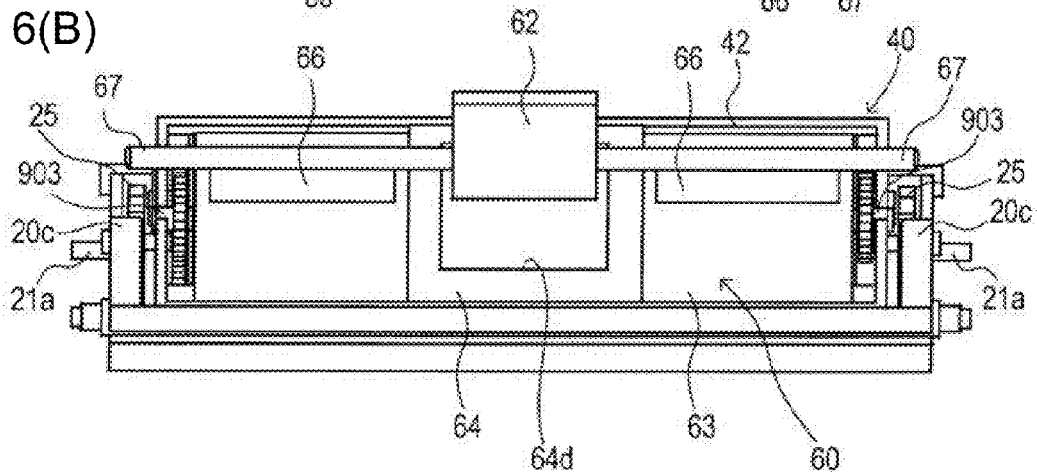

Next, FIG. 6(A) is a drawing of the photoconductor cartridge 20, the developing cartridge 40, and the toner cartridge 60 as seen from the front surface side when the operation part 62 has been arranged at the aforementioned installation position, and FIG. 6(B) is a drawing of the photoconductor cartridge 20, the developing cartridge 40, and the toner cartridge 60 as seen from the front surface side when the operation part 62 has been arranged at the aforementioned removal position.

As shown in FIGS. 6(A) and (B), an aperture part 64*d* that passes through the operation part 62 so that rotation is possible in the aforementioned way is formed on the front surface side of the outer cylinder 64. In addition, protruding parts 67 that are supported on the surface of the inner cylinder 63 by support parts 66 and that protrude in the left and right direction further than the installation part 42 are provided on both the left and right side surfaces of the operation part 62.

Figure 7A:
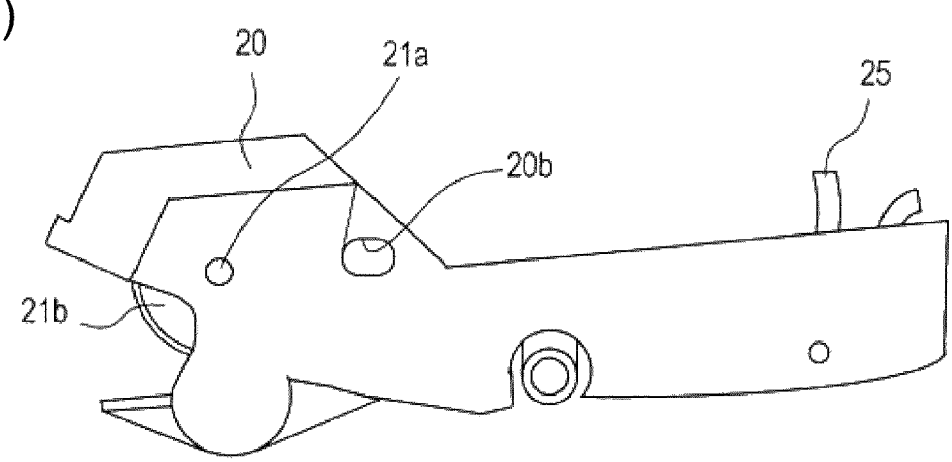
FIG. 7 is a side surface view that shows the configuration of the photoconductor cartridge of the laser printer and a partial view that shows the configuration from the inner surface side.
Figure 7B:
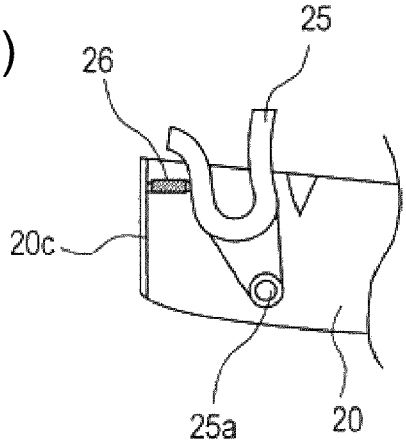

FIG. 7(A) is a side view that shows the configuration of the photoconductor cartridge 20, and FIG. 7(B) is a partial view that shows the configuration of the front surface side end portion of the photoconductor cartridge 20 from the inner surface side. As shown in FIG. 7(B), concave spring parts 25 into which protruding parts 67 fit when the operation part 62 has been arranged at the installation position are arranged in the vicinity of the front surface side end part of the photoconductor cartridge 20. The spring parts 25 are configured to be slidable centering on fulcrums 25*a* and impart energy in the direction of the photoconductor drum 21 through compression coil springs 26 in relation to receiving plates 20*c* molded as a unit at the front surface side of the photoconductor cartridge 20.

Figure 8A:
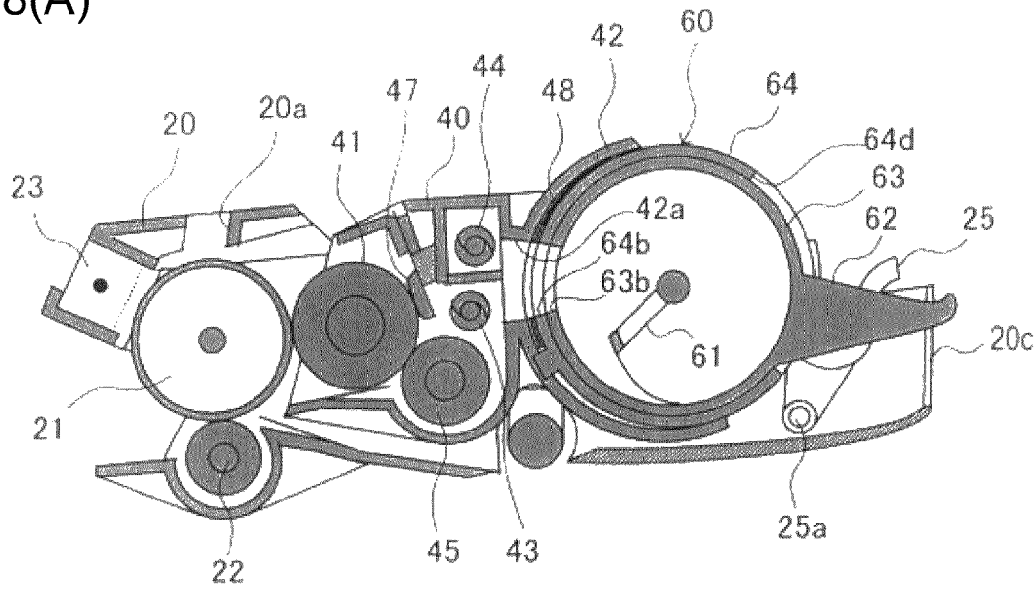
FIG. 8 is an explanatory drawing that shows displacement of the developing roller according to the installation and removal of the toner cartridge.

For this reason, when the operation part 62 is rotated to the installation position, and the protruding parts 67 are fit into the spring parts 25, as shown in FIG. 8(A), the developing cartridge 40 is pressed in the direction of the photoconductor drum 21 via the toner cartridge 60, and the developing roller 41 is pressure attached to the photoconductor drum 21. In addition, at this time, the shutter 48 is opened, engagement parts 63*c* and rails 42*c* engage, and aperture parts 42*a*, 63*b*, and 64*b* communicate, so it is possible to perform image formation in the aforementioned way.

Figure 8B:
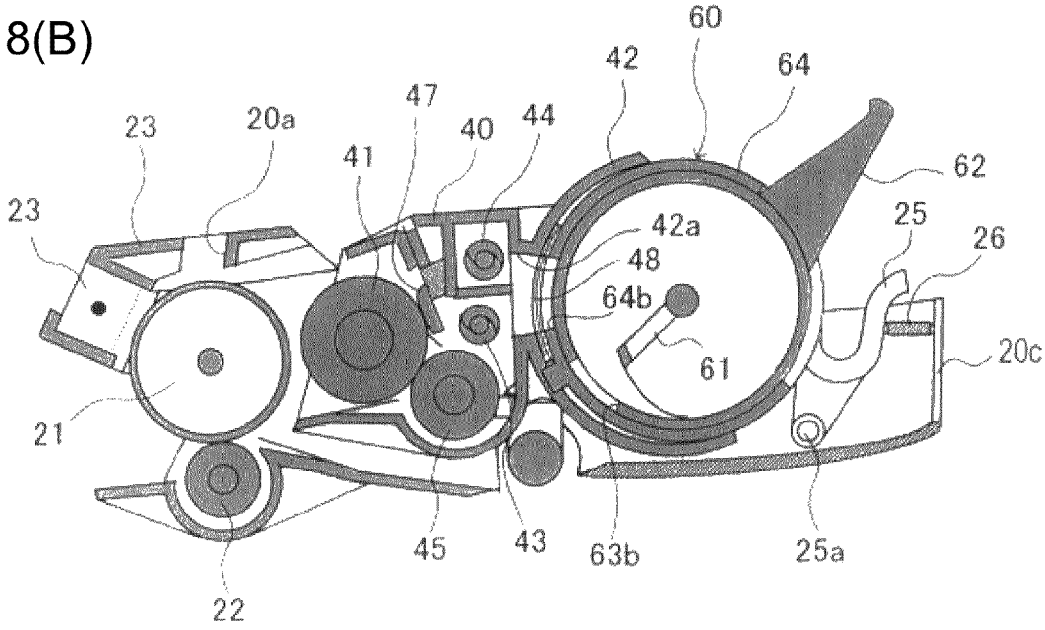

Conversely, when the operation part 62 is rotated to the removal position, and the fitting of the protruding parts 67 and the spring parts 25 is undone, as shown in FIG. 8(B), the aforementioned pressing is released. In addition, at this time, the shutter 48 is closed, the engagement of engagement parts 63*c* and rails 42*c* is released, and aperture parts 63*b* and 64*b* are arranged to be mutually unaligned, so it is possible to remove the toner cartridge 60 without spilling toner. Note that, as shown in FIG. 6, the receiving plates 20*c* and the spring parts 25 are arranged at the outer side in the left and right directions of the toner cartridge 60 and the installation part 42, so these do not become and obstruction at the time of installation and removal of the toner cartridge 60. Also, as shown in FIG. 2 and FIG. 3, and interference member 4*c* is provided in a protruding manner at the inner surface of the lid part 4, and the configuration is such that, if the operation part 62 is not arranged at the installation position, that operation part 62 and interference member 4*c* interfere with each other, and it is not possible to close the lid part 4.

Next, the mechanism for transmitting driving force to the developing roller 41, etc. will be explained. Returning to FIG. 7(A), a metal rotary shaft 21*a* of the photoconductor drum 21 protrudes from the photoconductor cartridge 20 at both the left and right sides, and a gear 21*b* that rotates in unison with the photoconductor drum 21 is exposed from the end portion of the rear side (installation direction side) of the photoconductor cartridge 20.

Figure 9:
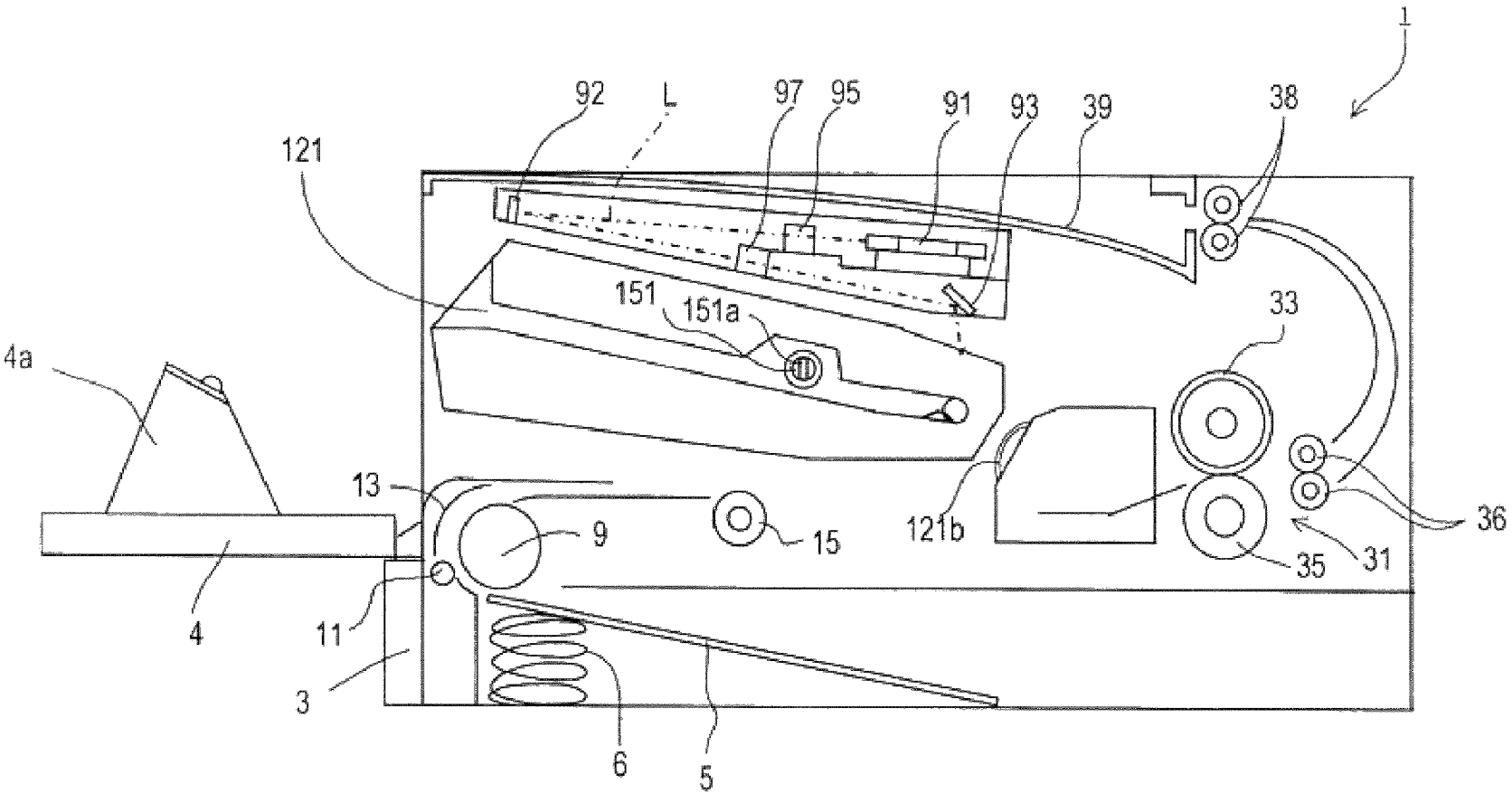
FIG. 9 is an explanatory drawing that shows an illustrative configuration of the left side inner wall surface of the laser printer main body.

In contrast with this, as shown in FIG. 9, a guide groove 121 that guides the rotary shaft 21*a* is formed on the inner wall surface of the left side of the main body of the laser printer 1, and a gear 121*b* that meshes with gear 21*b* is provided. By this gear 21*b* and gear 121*b* meshing with each other at the time of installation of the photoconductor drum 20, driving force can be transmitted from the main body side to the photoconductor drum 21.

Figure 10A:
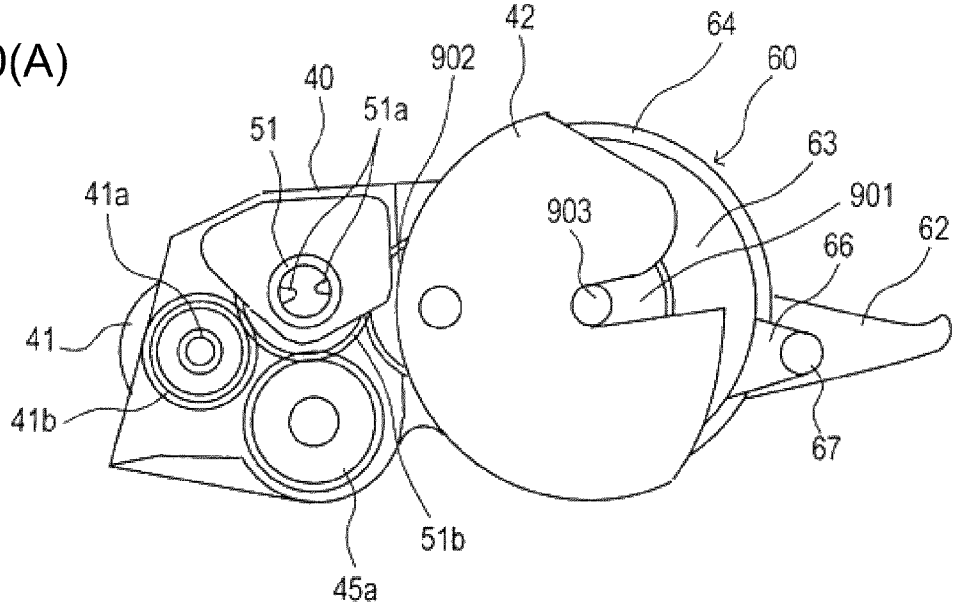
FIG. 10 is a left side surface view and a right side surface view, which show illustrative configurations of the developing cartridge and toner cartridge.
Figure 10B:
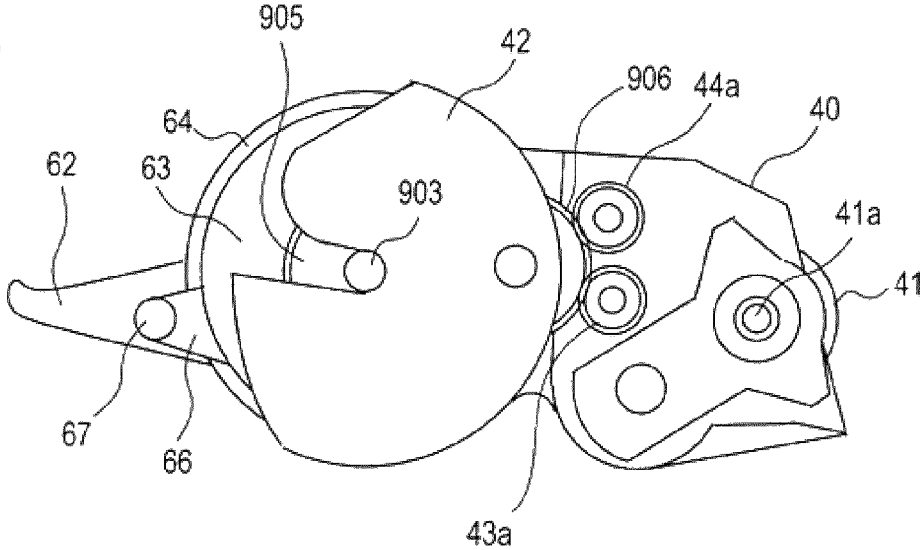

To continue, FIG. 10(A) is a left side surface view that shows the configuration of the developing cartridge 40 and the toner cartridge 60, and FIG. 10(B) is a right side surface view that shows the configuration of the developing cartridge 40 and the toner cartridge 60. As shown in FIG. 10(A), a drive shaft 51 through which driving force is transmitted from the drive shaft 151 (see FIG. 9) of the main body side is provided at the left side surface of the developing cartridge 40. Note that, in addition to drive shaft 151, at the end face, comprising a flat protruding part 151*a* and drive shaft 51 being formed into a cylindrical concave part into which drive shaft 151 can fit, a protrusion 51*a* that is able to engage with flat protruding part 151*a* is formed, and a so-called drive coupling is formed by the two.

As shown in FIG. 10(A), a gear 51*b* that rotates in unison is formed on drive shaft 51, and this gear 51*b* meshes with a gear 41*b* that rotates in unison with the developing roller 41, a gear 45*a* that rotates in unison with the supply roller 45, and gear 902 discussed above. In addition, gear 901, which rotates in unison with rotary shaft 903 of the agitator 61 meshes with gear 902 at the time of installation of the toner cartridge 60 in the aforementioned way, and, in the same way, driving force is transmitted to a gear 906 via a gear 905 that rotates in unison with rotary shaft 903.

As shown in FIG. 10(B), gear 906 meshes with gears 43*a* and 44*a*, which respectively rotate in unison with the lower auger 43 and the upper auger 44. For this reason, driving force is transmitted from drive shaft 151 to drive shaft 51, and, through that driving force, it is possible to rotate the developing roller 41, the supply roller 45, the agitator 61, the lower auger 43, and the upper auger 44.

In a laser printer 1 configured in the above way, if the toner cartridge 60 is caused to be removed from the installation part 42 at the time of shipping, it is possible to maintain a state in which the pressure attachment of the photoconductor drum 21 and the developing roller 41 has been released as shown in FIG. 8(B). For this reason, it is possible to prevent chemical damage to the photoconductor drum 21 and permanent deformation of the developing roller 41.

Also, as shown in FIG. 8(A), it is possible to pressure attach the developing roller 41 to the photoconductor drum 21 merely by installing the toner cartridge 60 in the installation part 42, so operability at the time of the start of usage is improved. Furthermore, the pressure attachment is released again when the toner cartridge 60 is removed from the installation part 42 and replaced, so it is possible to better prevent chemical damage to the photoconductor drum 21 and permanent deformation of the developing roller 41. Moreover, at this time, the rotary shaft 41*a* of the developing roller 41 is guided by a slot 20*b*, so it is possible to perform the pressure attachment and pressure attachment release even more smoothly, and the positional relationship between the photoconductor drum 21 and the developing roller 41 also becomes difficult to move.

In addition, if the toner cartridge 60 is installed in the installation part 42, in the manner discussed above, the photoconductor drum 20, the developing cartridge 40, and the toner cartridge 60 are made into a unit, and it is possible to perform installation and removal as a unit along the guide groove 121. Therefore, in the laser printer 1, the ability to resolve jam handling can be improved. Also, by the protruding parts 67 fitting into the spring parts 25 and pressing the toner cartridge 60 in the direction of the developing cartridge 40, a state in which the photoconductor drum 20, the developing cartridge 40, and the toner cartridge 60 are joined is maintained at least two locations, making it possible to reinforce the strength of the rails 42*c* and the engagement parts 63*c*.

Note that, in the above illustrative aspect, the photoconductor cartridge 20, the developing cartridge 40, and the toner cartridge 60 can correspond to a process cartridge, the photoconductor cartridge 20 and the developing cartridge 40 can correspond to the main body cartridge, the housing portion of the photoconductor cartridge 20 and the developing cartridge 40 can correspond to the housing, protruding parts 67, spring parts 25, and compression coil springs 26 or like can correspond to the pressure attachment device, rails 42*c* and engagement parts 63*c* can correspond to the engagement parts, protruding parts 67 and the fitting parts can correspond to the action receiving parts, spring parts 25 can correspond to the fitting receiving parts, and shutter 48 and outer cylinder 64 can correspond to the shielding member.

Figure 11A:
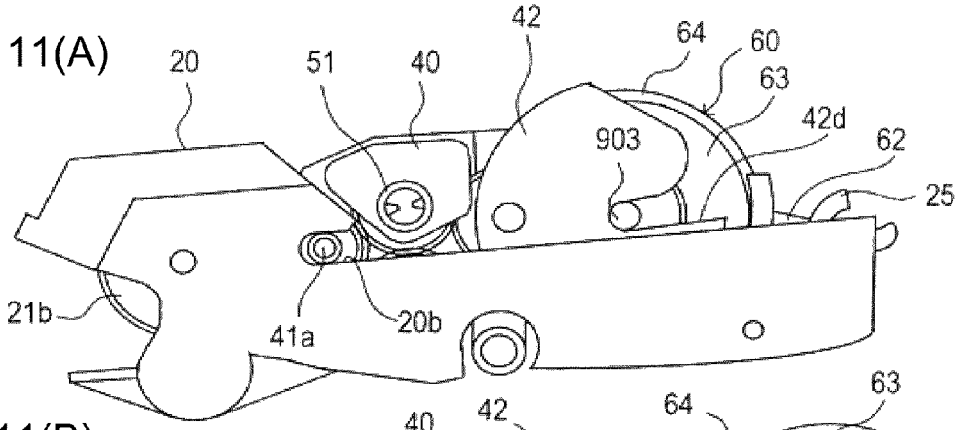
FIG. 11 is an explanatory drawing that shows an illustrative configuration and action of a modified form of the photoconductor cartridge.
Figure 11B:
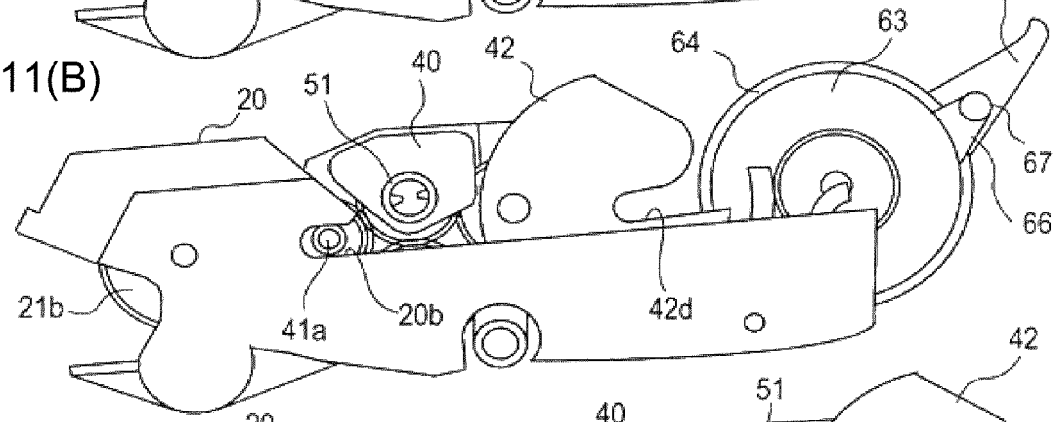
Figure 11C:
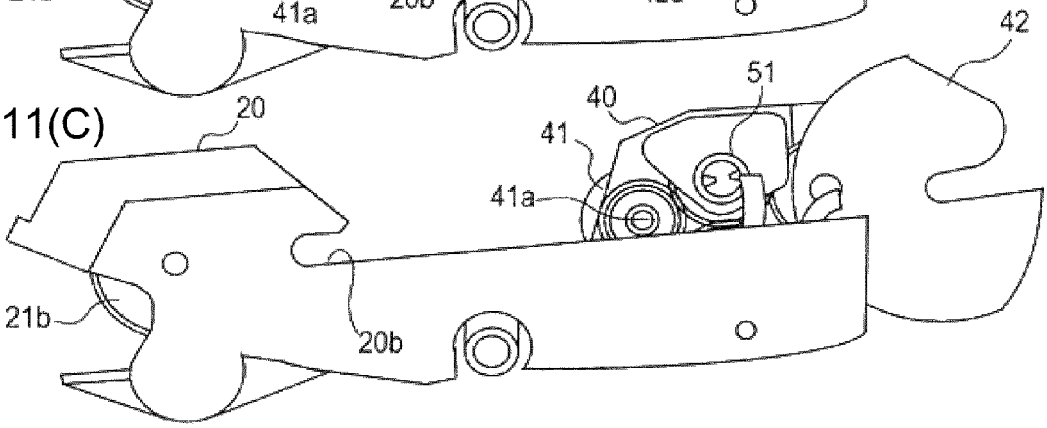

Also, aspects of the present invention are not limited in any way to the above described aspects, and it is possible to implement various modes within a scope that comports with aspects of the present invention. For example, as shown in FIG. 11, the slot 20*b* may be opened on the toner cartridge 60 side. In this case, from the state shown in FIG. 11(A), when the toner cartridge 60 is removed as shown in FIG. 11(B) in the same way as in the above aspect, as shown in FIG. 11(C), it is possible to easily separate the developing cartridge 40 from the photoconductor cartridge 20. Therefore, it is possible to respectively individually replace the photoconductor cartridge 20, the developing cartridge 40, and the toner cartridge 60 according to the lifespan of the photoconductor drum 21 and the developing roller 41, etc.

Figure 12A:
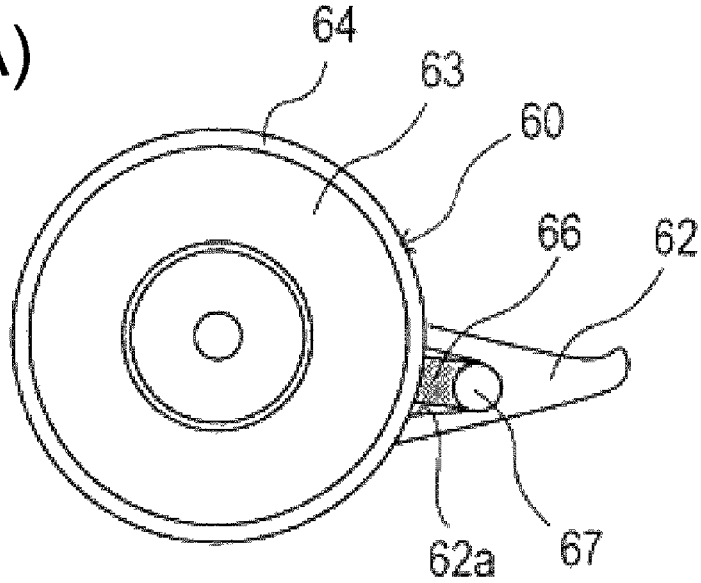
FIG. 12 is an explanatory drawing that shows an illustrative configuration and action of a modified form of the toner cartridge.
Figure 12B:
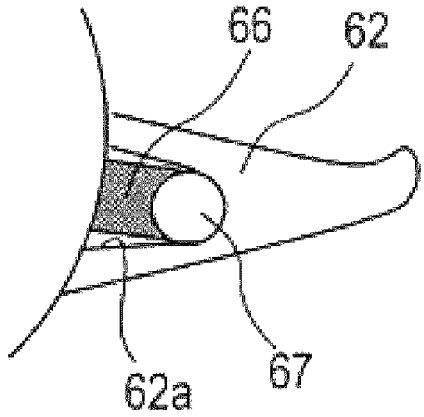
Figure 12C:
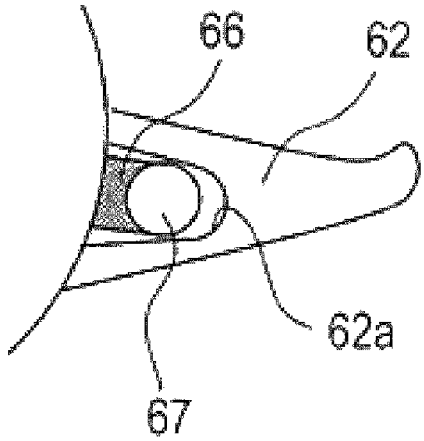

In addition, an elastic member that generates a pressing force for attaching the developing roller 41 to the photoconductor drum 21 may be provided on the toner cartridge 60 side. FIG. 12(A) is a side surface view that shows the configuration of the toner cartridge 60 according to this aspect. As shown in FIG. 12(A) and in FIG. 12(B) as a partial enlarged drawing thereof, in addition to holes 62*a* being bored in the vicinity of protruding parts 67 of the operation part 62, protruding parts 67 are formed by a single shaft that passes through the holes 62*a*. In addition, the support parts 66 of protruding parts 67 are formed by elastic members such as rubber, and the protruding parts 67 are made displaceable within the holes 62*a* shown in FIG. 12(C) by elastic deformation of the support parts 66.

Figure 13A:
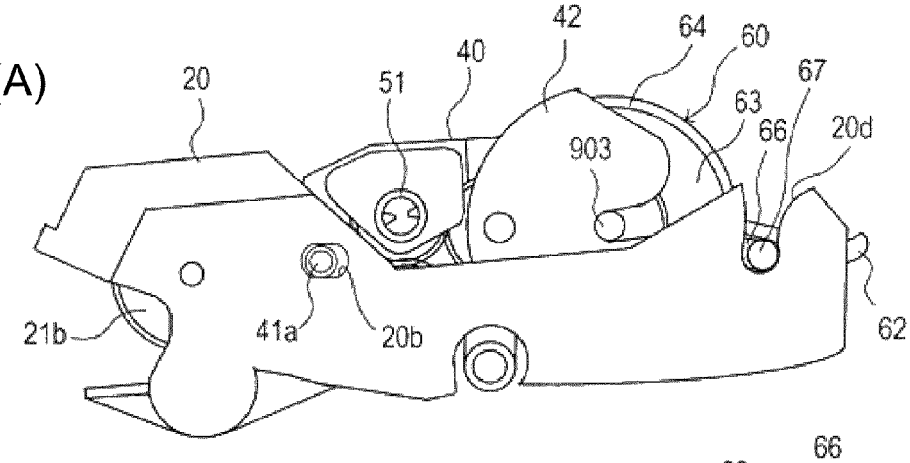
FIG. 13 is an explanatory drawing that shows an illustrative configuration and action of a modified form of a photoconductor cartridge corresponding to the toner cartridge.
Figure 13B:
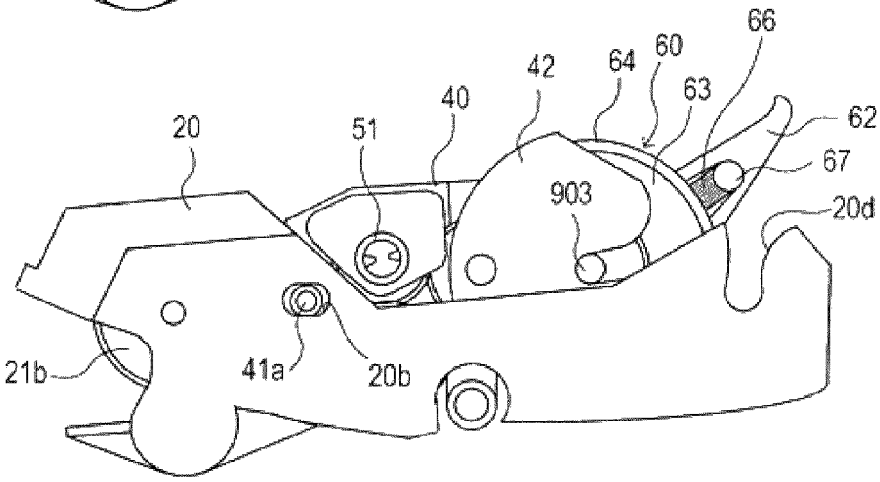
Figure 13C:
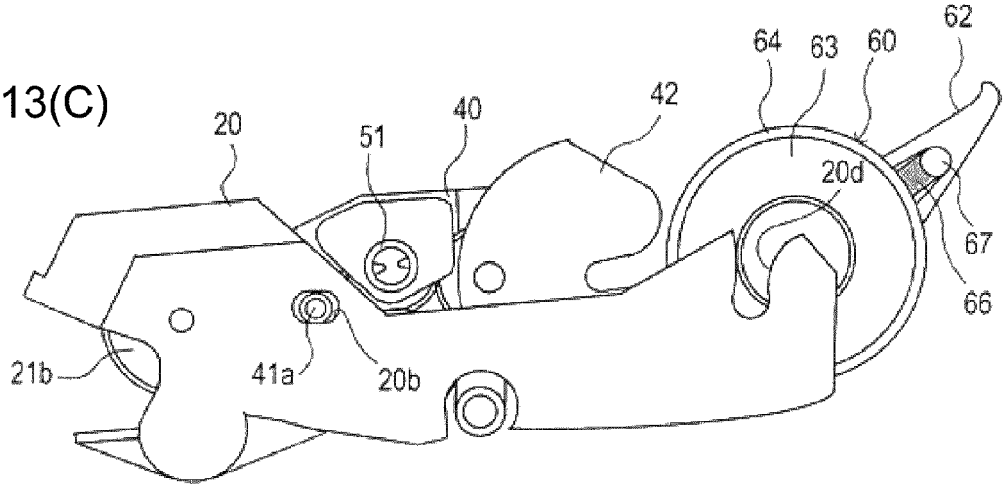

In this case, there is no need to provide spring parts 25 in the photoconductor cartridge 20, and, as shown in FIG. 13, concave fitting receiving parts 20*d* into which the protruding parts 67 fit may be provided. According to this aspect, when the operation part 62 is arranged at the installation position, and the protruding parts 67 are fit into the fitting receiving parts 20*d* as shown in FIG. 13(A), it is possible apply a pressing force to attach a developing roller 41 to a photoconductor drum 21 by the imparted energy applied from the support parts 66. When the operation part 62 is arranged at the removal position as shown in FIG. 13(B), the aforementioned fitting is undone, and it is possible to release the aforementioned pressure attachment, and, in that state, it is possible to remove the toner cartridge 60 as shown in FIG. 13(C). Note that, according to this aspect, the support parts 66 may be configured by coil springs or plate springs other than rubber ones. Furthermore, the attachment may be performed by fitting resin protruding parts and fitting receiving parts with each other without using elastic members.

Furthermore, aspects of the present invention can also be applied to image forming apparatuses of the type in which the toner cartridge is installed and removed from the side of the developing cartridge. In this case as well, if the configuration is such that the toner cartridge is replaced once the entire process cartridge is removed, by using an appropriate link mechanism, etc., it is possible to link the installation and removal of the toner cartridge with the aforementioned pressure attachment/pressure attachment release. However in the above respective aspects, it is possible to individually replace the toner cartridge 60 from the front side of the laser printer 1, which can result in improved maintenance.

Figure 14:
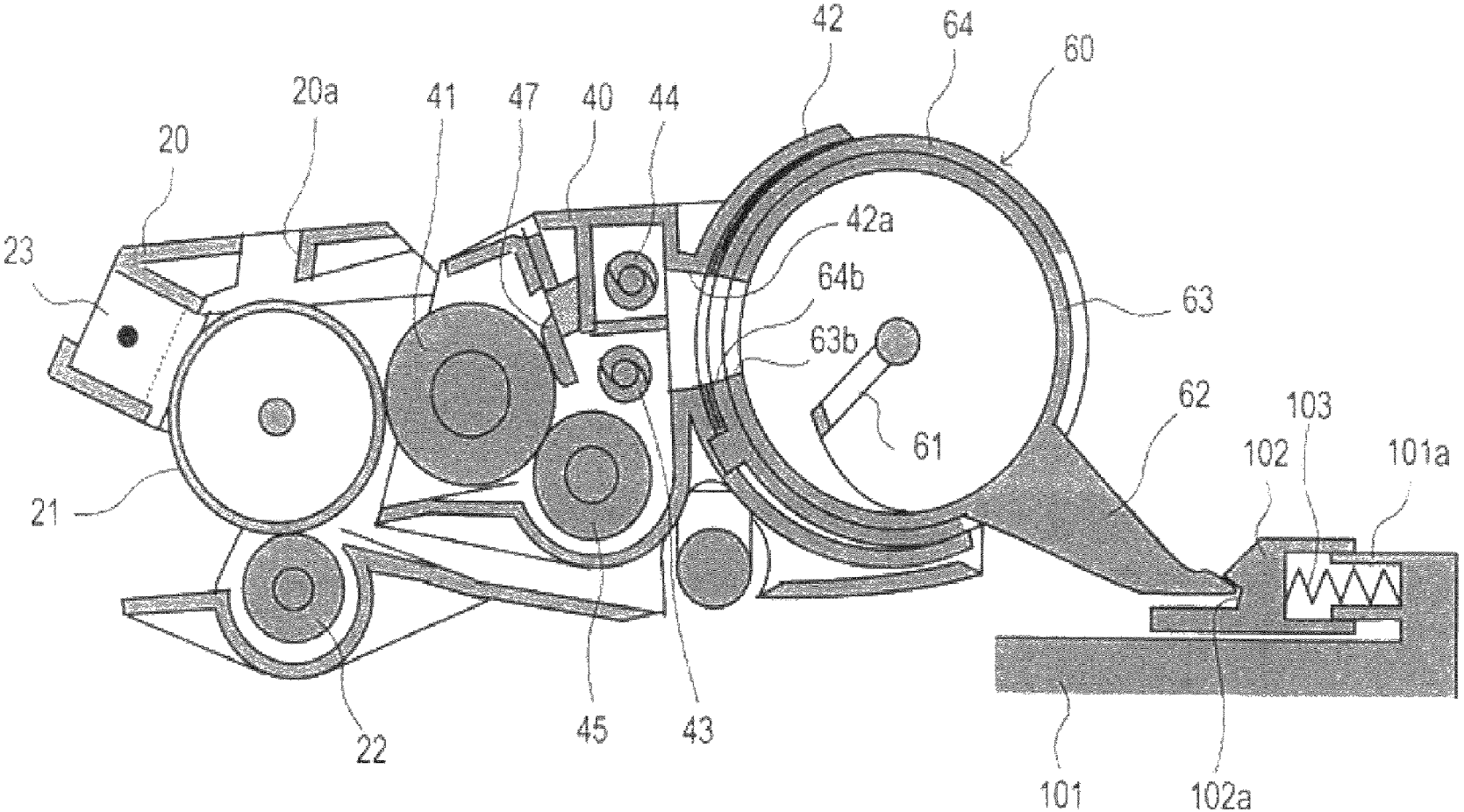
FIG. 14 is an explanatory drawing that shows an illustrative configuration of a modified form of the laser printer main body.

In addition, the pressure attachment device may be provided on the image forming apparatus main body. FIG. 14 is a vertical cross sectional view that shows the configuration according to this aspect. As shown in FIG. 14, a pressing member 102 as the pressure attachment device is arranged on a support plate 101 that supports the photoconductor cartridge 20 in the main body of the laser printer 1. This pressing member 102 is provided so that it is able to slide in the forward and back directions by way of a guide 101*a* integrated with the support part 101. The pressing member 102 also imparts energy toward the back by a coil spring 103. In addition, the pressing member 102 includes a groove part 102*a* that engages with the operation part 62 when that operation part 62 is arranged at the installation position.

For this reason, when the toner cartridge 60 is installed on the installation part 42, and the operation part 62 is rotated to the operation position, the operation part 62 engages with the groove part 102*a*, and the imparted energy of the coil spring 103 is transmitted to the developing roller 41 by the toner cartridge 60. On the other hand, at the time of replacement of the toner cartridge 60, the operation part 62 is rotated to the removal position while pulling the pressing member 102 to the front. When this is done, the aforementioned imparted energy is transmitted to the developing roller 41, and it also becomes possible to remove the toner cartridge 60. Therefore, according this aspect, the same action and effects as in the aforementioned respective aspects are produced.

While the invention has been described in detail with reference to the specific embodiment thereof, it would be apparent to those skilled in the art that various changes and modifications may be made therein without departing from the spirit of the invention.

The invention claimed is:

1. A combination comprising:

a photoconductor cartridge including:

a photoconductor drum, a first housing configured to support the photoconductor drum, and a slot being formed in the first housing;

a developing cartridge configured to be removably installed in the photoconductor cartridge, the developing cartridge including:

a developing roller configured to hold toner thereon, and a second housing configured to support the developing roller, the developing roller being configured to be supported in the slot when the developing cartridge is installed in the photoconductor cartridge; and a toner cartridge configured to hold the toner therein, the toner cartridge being configured to be removably installed in the developing cartridge, wherein the photoconductor cartridge further includes an attachment device provided in the first housing, the attachment device being configured to apply a pressing force to the toner cartridge to cause the developing roller to move along the slot when the toner cartridge is installed in the developing cartridge.

2. The combination according to claim 1, wherein the toner cartridge includes an operation part that is positioned at a first position and a second position selectively, and the attachment device applies the pressing force to the toner cartridge when the operation part has been positioned at the first position, and releases the pressing force when the operation part has been positioned at the second position.

3. The combination according to claim 2, wherein the developing cartridge includes a first engagement part and the toner cartridge includes a second engagement part, the first engagement part engaging the second engagement part when the operation part has been positioned at the first position.

4. The combination according to claim 3, wherein the developing cartridge includes a first aperture and the toner cartridge including a second aperture, the first aperture and the second aperture communicating an interior portion of the housing with an interior portion of the toner cartridge.

5. The combination according to claim 4, wherein the developing cartridge includes a first shielding member and the toner cartridge includes a second shielding member, when the operation part has been positioned at the first position, the first shielding member opens the first aperture, and the second shielding member opens the second aperture, and when the operation part has been positioned at the second position, the first shielding member covers the first aperture, and the second shielding member covers the second aperture.

6. The combination according to claim 2 wherein the attachment device comprises an elastic member configured to generate the pressing force when the operation part is at the first position, the elastic member being configured not to generate the pressing force when the operation part is at the second position.

7. The combination according to claim 1, wherein the developing cartridge includes an installation portion in which the toner cartridge is configured to be placed, and the developing roller is arranged between the photoconductor drum and the installation portion and is configured to move along a linking direction, the linking direction being the direction that links the photoconductor drum and the installation portion.

8. The combination according to claim 7, wherein a shaft of the developing roller is guided in the linking direction.

9. The combination according to claim 8, wherein the shaft of the developing roller is placed and guided in the slot of the first housing.

10. The combination according to claim 1, wherein the attachment device includes an elastic material configured to apply the pressing force.

11. The combination according to claim 10, wherein the attachment device includes a fitting part, which is provided on the toner cartridge and a fitting receiving part, which is provided on the photoconductor cartridge.

12. The combination according to claim 11, wherein the toner cartridge includes a pair of sidewalls opposing each other and the photoconductor cartridge includes a pair of sidewalls, the fitting part being arranged in each of the pair of sidewalls of the toner cartridge, and the fitting receiving part being arranged in each of the pair of sidewalls of the photoconductor cartridge.

13. The combination according to claim 12, wherein the fitting part is a protrusion that protrudes from the each of the pair of sidewalls of the toner cartridge, and the fitting receiving part is a spring part that fits the protrusion to apply the pressing force to the protrusion.

14. The combination according to claim 13, wherein the spring part is formed in a concave shape to allow the protrusion to fit therein.

* * * * *